US008010006B2

(12) United States Patent
Matsubara et al.

(10) Patent No.: US 8,010,006 B2
(45) Date of Patent: Aug. 30, 2011

(54) FIXING DEVICE, IMAGE-FORMING DEVICE, AND FIXING METHOD

(75) Inventors: Takashi Matsubara, Ashigarakami-gun (JP); Miho Watanabe, Ashigarakami-gun (JP); Shinji Hasegawa, Ashigarakami-gun (JP); Makoto Furuki, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 187 days.

(21) Appl. No.: 12/500,229

(22) Filed: Jul. 9, 2009

(65) Prior Publication Data

US 2010/0202790 A1 Aug. 12, 2010

(30) Foreign Application Priority Data

Feb. 6, 2009 (JP) ..... 2009-026590

(51) Int. Cl.
*G03G 15/20* (2006.01)

(52) U.S. Cl. ..... 399/67; 399/336

(58) Field of Classification Search ..... 399/320, 399/336, 67, 69; 219/216, 469–471
See application file for complete search history.

(56) References Cited

U.S. PATENT DOCUMENTS

| | | | | |
|---|---|---|---|---|
| 2002/0075376 | A1 | 6/2002 | McIlvaine et al. | |
| 2005/0028698 | A1 * | 2/2005 | Mori et al. | |
| 2008/0101832 | A1 * | 5/2008 | Yaoi et al. | 399/336 |
| 2008/0160450 | A1 * | 7/2008 | Schlorholz et al. | |

FOREIGN PATENT DOCUMENTS

| | | |
|---|---|---|
| JP | A-56-164374 | 12/1981 |
| JP | A 57-2069 | 1/1982 |
| JP | A 59-95575 | 6/1984 |
| JP | A 5-134578 | 5/1993 |
| JP | A-7-325493 | 12/1995 |
| JP | A-2002-202686 | 7/2002 |
| JP | A-2008-185638 | 8/2008 |

OTHER PUBLICATIONS

Notification of Reasons for Refusal dated Jan. 18, 2011 in corresponding Japanese Patent Application No. 2009-026590 (with translation).

* cited by examiner

*Primary Examiner* — Susan Lee
(74) *Attorney, Agent, or Firm* — Oliff & Berridge, PLC

(57) ABSTRACT

A fixing device includes: a fixing unit that irradiates light to a color material transferred to a medium at a position specified by image data, to fix the color material on the medium; and a control unit that controls irradiation of light of the fixing unit so that an energy of light irradiated to an image-forming area on the medium including an area in which the color material has been transferred at the position specified by the image data is lower than an energy of light irradiated to a non image-forming area on the medium other than the image-forming area.

5 Claims, 3 Drawing Sheets

FIG. 1
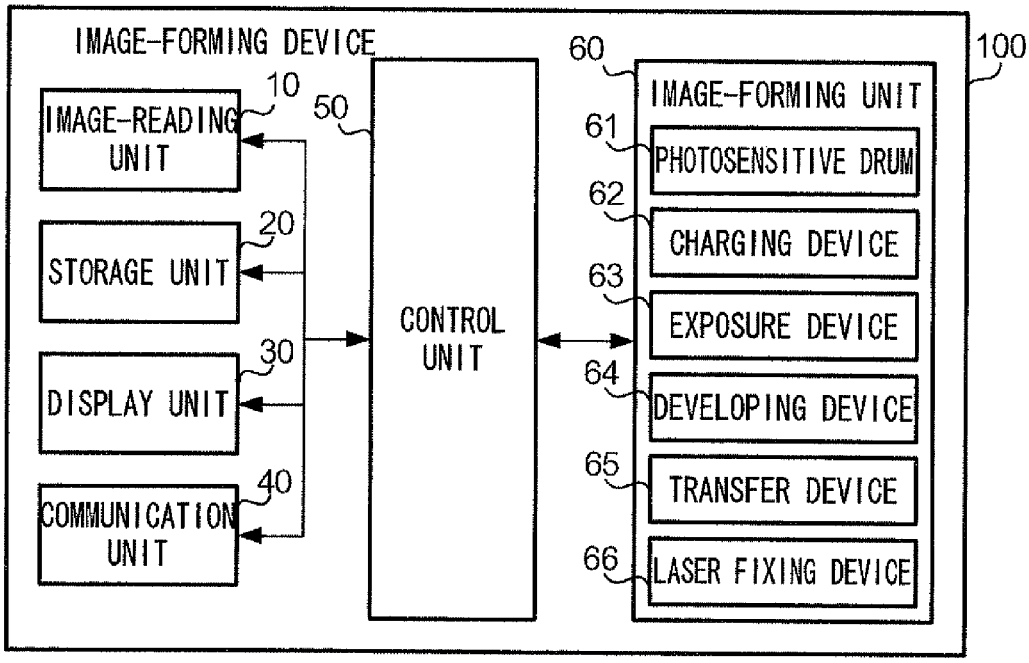
FIG. 2A
FIG. 2C
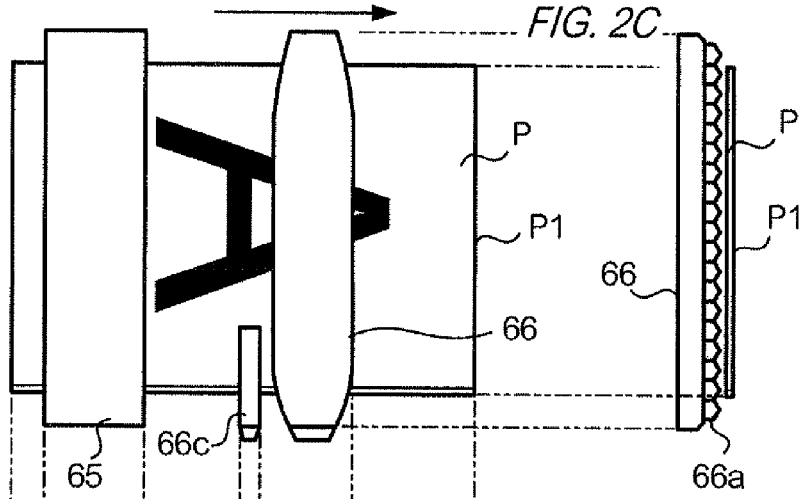
FIG. 2B
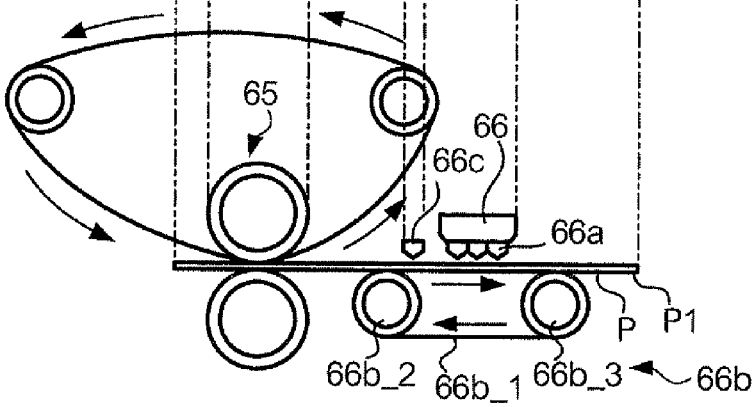

FIXING DEVICE, IMAGE-FORMING DEVICE, AND FIXING METHOD

CROSS-REFERENCE TO RELATED APPLICATIONS

This application is based on and claims priority under 35 USC 119 from Japanese Patent Application No. 2009-026590 filed on Feb. 6, 2009.

BACKGROUND

1. Technical Field

The present invention relates to a fixing device, an image-forming device, and a fixing method.

2. Related Art

An image-forming device such as a printer or a copier develops an image using a color material such as a toner, transfers the image to a medium such as a sheet, and fixes the image on the medium using a fixing device.

SUMMARY

An aspect of the present invention provides a fixing device including: a fixing unit that irradiates light to a color material transferred to a medium at a position specified by image data, to fix the color material on the medium; and a control unit that controls irradiation of light of the fixing unit so that an energy of light irradiated to an image-forming area on the medium including an area in which the color material has been transferred at the position specified by the image data is lower than an energy of light irradiated to a non image-forming area on the medium other than the image-forming area.

BRIEF DESCRIPTION OF THE DRAWINGS

Exemplary embodiments of the present invention will now be described in detail below with reference to the following figures, wherein:

FIG. 1 is a block diagram showing a configuration of an image-forming device according to an exemplary embodiment of the present invention;

FIG. 2 is a diagram showing an example of a configuration pertaining to a transfer device and a laser fixing device according to the same exemplary embodiment;

DETAILED DESCRIPTION

Figure 3:
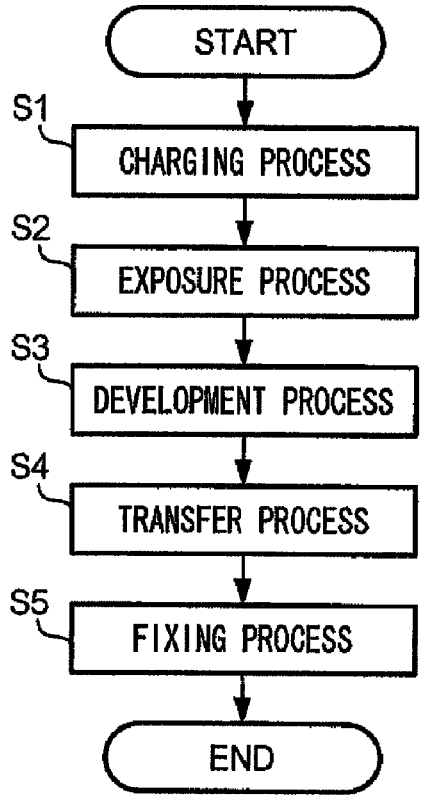
FIG. 3 is a flowchart illustrating an operation of an image-forming device according to the same exemplary embodiment, to form an image on a sheet.

An exemplary embodiment of the present invention will now be described in detail.

(1) Configuration

FIG. 1 is a block diagram showing a configuration of electro-photographic image-forming device 100 such as a printer or a copier. Image-forming device 100 includes image-reading unit 10, storage unit 20, display unit 30, communication unit 40, control unit 50, and image-forming unit 60. Image-reading unit 10 includes an optical system including a CCD (Charge Coupled Device) and a document feeder. Image-reading unit 10 reads an image of a document fed onto a platen glass by the document feeder, using the optical system, and generates image data based on the read image. Namely, image-reading unit 10 functions as an example of an obtaining unit that obtains image data. Storage unit 20 is a nonvolatile auxiliary storage device such as an HD (Hard Disk). Storage unit 20 stores a program to be executed by control unit 20, described later, and information necessary to form an image. Display unit 30 includes a VRAM (Video RAM), a liquid crystal display, and a liquid crystal driving circuit, which displays information under control of control unit 50 described later Display unit 30 is configured as a touch panel. Display unit 30 serves as an operation unit that receives an operation of a user and provides a signal corresponding to the operation to a control unit. Communication unit 40 includes a communication circuit and a communication interface, which receives image data transmitted from a client device such as a personal computer via a network such as a LAN (Local Area Network). Communication unit 40 functions as an example of an obtaining unit that obtains image data. Control unit 50 includes a CPU (Central Processing Unit) and a memory, which controls components of image-forming device 100. Especially, control unit 50 controls irradiation of laser light by laser fixing device 66 of image-forming unit 60.

Image-forming unit 60 is an example of an image-forming unit that forms an image represented by image data on a recording medium such as a sheet by use of electro-photography. Image-forming unit 60 includes photosensitive drum 61 which is an image carrier, charging device 62 that evenly changes a photosensitive layer of photosensitive drum 61, exposure device 63 that irradiates laser light to a photosensitive layer of photosensitive drum 61 to form an electrostatic latent image, developing device 64 that develops an electrostatic latent image on a photosensitive layer of photosensitive drum 61, using toner, transfer device 65 that transfers a toner image to a sheet, and laser fixing device 66 that irradiates laser light to a toner image transferred to a sheet to fix the toner image on the sheet.

FIGS. 2A to 2C are diagrams showing a configuration pertaining to transfer device 65 and laser fixing device 66. FIG. 2A is a top view of laser fixing device 66, FIG. 2B is a side view of laser fixing device 66, and FIG. 2C is a front view of laser fixing device 66. It is to be noted that in the top view and the front view, a part of transfer device 66 is not shown.

Laser fixing device 66 functions as an example of a fixing unit that heats a toner image transferred to sheet P, by irradiation of laser light to fix the toner image on sheet P. Laser fixing device 66 includes sheet transport device 66*b* that transports sheet P, laser light sources 66*a* that are arranged in a grid pattern and irradiate laser light, and sensor 66*c*. Sheet transport device 66*b* includes circular belt 66*b*_1, and driving roll 66*b*_2 and driven roll 66*b*_3 on which circular belt 66*b*_1 is mounted so that the belt is rotatable. Circular belt 66*b*_1 is made of, for example, a heat-resistant resin such as polyimide. Driving roll 66*b*_2 and driven roll 66*b*_3 are arranged side-by-side in a horizontal direction, and circular belt 66*b*_1 mounted on the rolls transports sheet P in a horizontal direction. Control unit 50 controls sheet transport device 66*b* and transfer device 65 so that a transport speed of transport device 66*b* and a transfer speed of transfer device 65 are equal to each other. Laser light sources 66*a* irradiate laser light to a toner image transferred onto sheet P. Toner on sheet P melts under heat generated by irradiation of laser light, and is fixed on sheet P. Irradiation energy of laser light irradiated from each of laser light sources 66*a* is controlled by control unit 50. Sensor 66*c* detects a timing at which edge P1 of transported sheet P passes the sensor.

In image-forming unit 60, when an electrostatic latent image is formed on a surface of photosensitive drum 61 by exposure, and the electrostatic latent image is developed by applying toner to an area corresponding to the electrostatic latent image, a possibility exists that toner may undesirably be applied areas other than that corresponding to the electrostatic image. Toner that is undesirably applied areas other than that corresponding to the electrostatic image will be hereinafter be referred to as undesirably applied toner. Undesirably applied toner is toner that is not supplied with sufficient light irradiation energy to fix the toner to a surface of a sheet by a fixing device. As a result the non-fixed toner tends to disperse in an image-forming device thereby leading to contamination of and consequent problems in the image-forming device.

Now, a reason for the occurrence of undesirably applied toner and attributes of such toner will be described.

Image-forming device 100 transfers toner from developing device 64 to photosensitive drum 61 on which an electrostatic latent image is formed, to develop the electrostatic latent image. Upon transfer of the toner by image forming device 100 from the developing device to the photosensitive drum, there is generated a predetermined difference in a surface potential of an area of an electrostatic image on the drum and a bias potential of developing device 64. In this way, toner can be prevented from being applied to an area of photosensitive drum 61 other than that of the electrostatic latent image. However, if a toner is not properly charged, for example, if the toner is provided with a low charge only, or with no charge, or with a charge opposite to one required, a result is that such improperly charged toner may be undesirably applied to an area of the drum other than that of the area of the electro static image.

When undesirably applied toner is transferred to a sheet it is applied dispersedly, and will therefore have a larger surface area that is exposed to air than a toner that is densely applied to the sheet. Accordingly, undesirably applied toner, namely, toner that is dispersedly applied to a sheet will upon irradiation with laser light more readily release radiation energy than toner that is densely applied to the sheet. Accordingly, to fix to a sheet toner that is undesirably and dispersedly applied to the sheet it is necessary to use a larger amount of energy than that required to fix toner that is densely applied to the sheet. However, if laser light is irradiated with sufficient energy to fix dispersedly applied toner to a sheet there is an undesirable effect in that moisture in the sheet is caused to evaporate and that in tan causes a properly, densely applied toner to overheat with sublimation of the densely applied toner and a dulling of its color.

(2) Operation

FIG. 3 is a flowchart illustrating an operation of image-forming device 100 to form an image on a sheet.

Control unit 50 of image-forming device 100 causes photosensitive drum 61 to rotate, and causes charging device 62 to evenly change a surface of rotating photosensitive drum 61 (step S1). Subsequently, control unit 50 causes exposure device 63 to irradiate laser light based on image data to the surface of photosensitive drum 61, thereby forming an electrostatic latent image at a position determined based on the image data on the surface (step S2). As a result of rotation of photosensitive drum 61, when the electrostatic latent image formed on the surface of photosensitive drum 61 reaches a position opposite to developing device 64, developing device 64 provides the electrostatic latent image with toner to develop the image, thereby forming a toner image on the surface of photosensitive drum 61 (step S3). As a result of further rotation of photosensitive drum 61, when the toner image formed on the surface of photosensitive drum 61 reaches a position where it comes into contact with a surface of transfer device 65, control unit 50 transfers the toner image to a sheet using electrostatic force (step S4). Control unit 50 transports the sheet to a position under laser fixing device 66, and causes laser fixing device 66 to irradiate laser light to the toner image, thereby fixing the toner image on the sheet using irradiation energy of the laser light.

Figure 4:
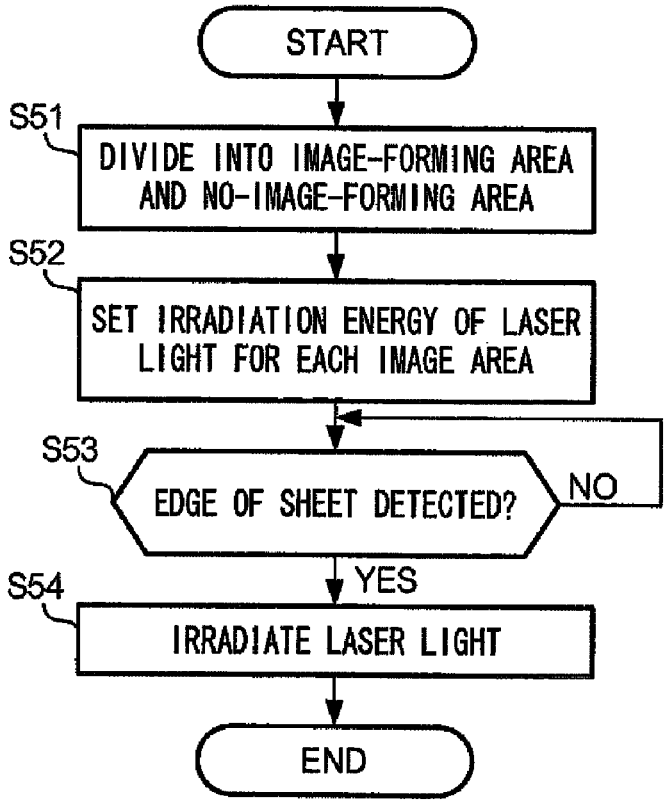
FIG. 4 is a flowchart illustrating a laser fixing operation according to the same exemplary embodiment.

FIG. 4 is a flowchart illustrating a laser fixing operation.

Control unit 50 divides an image represented by image data into an image-forming area including an area in which toner is transferred at a position specified by the image data and a no-image-forming area other than the image-forming area, on the basis of sizes of pixel values included in the image data (step S51). A specific method of dividing an image into a image-forming area and a non-image forming area includes a known method of performing labeling on the basis of image data, determining a bounding rectangle of an image identified by the labeling, and determining an area inside the bounding rectangle as an image-forming area, and the other area as a non image-forming area. For control unit 50 a known method may be used to divide an image into an image-forming area and a non image-forming area. If the method is employed, an image-forming area can include an area in which no image exists, in a strict sense. For example, in an image-forming area of an image of a word "A", there exists an image-forming area corresponding to lines forming the word "A" and a rectangular area surrounding the word "A". The latter rectangular area surrounding the word "A" is an area in which no image exists, in a strict sense. However, in the present exemplary embodiment, the rectangular area is deemed to belong to an image-forming area. Accordingly, an image-forming area can be said to be an area including an area in which toner is transferred at a position specified by image data, as described above.

Figure 5:
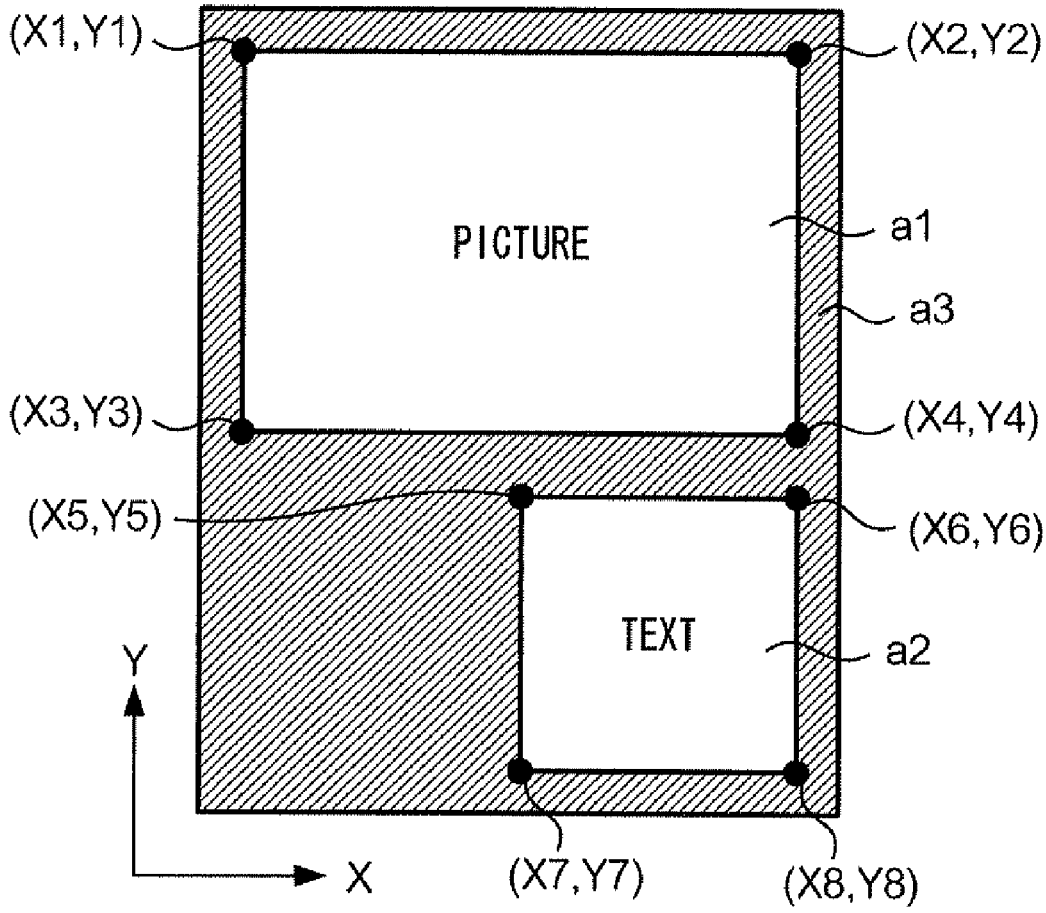
FIG. 5 is a diagram showing an image formed on a sheet by an image-forming device according to the same exemplary embodiment.

FIG. 5 is a diagram showing an example of an image represented by image data. In the drawing, area a1 with a description "Picture" is an image-forming area in which a picture image exists, and area a2 with a description "Text" is an image-forming area in which a text image exists. Area a3 marked with diagonal lines is a non image-forming area. Control unit 50 stores as positional data of an image-forming area, data on coordinate values of the four corners of an image-forming area in storage unit 20. The coordinate values are values of coordinates of an X-Y coordinate system with its origin at the bottom left corner of an image represented by image data. In the example shown in FIG. 5, positional data of image-forming area a1 is (X1, Y1), (X2, Y2), (X3, Y3), and (X4, Y4); and positional data of image-forming area a2 is (X5, Y5), (X6, Y6), (X7, Y7), and (X8, Y8).

Returning to the explanation of FIG. 4, control unit 50 stores positional data of the above-mentioned image-forming data and a value of irradiation energy of laser light in storage unit 20, in association with each other (step S52).

Irradiation energy of laser light is assumed to be 0.71 joules per square centimeter in a case of an image-forming area, and 4.00 joules per square centimeter in a case of a non image-forming area. Values of irradiation energy may be pre-defined by a designer of an image-forming device on the basis of experimental results or outcomes of simulations using various algorithms. Storage unit 20 stores a value of laser light irradiation intensity of laser light sources necessary to provide irradiation energy of 0.71 joules per square centimeter, and a value of laser light irradiation intensity of laser light sources necessary to provide irradiation energy of 4.00 joules per square centimeter. At step S52, for example, control unit 50 stores positional data of image-forming areas al and a2 appearing in FIG. 5 and a value of laser light irradiation intensity of laser light sources necessary to provide irradiation energy of 0.71 joules per square centimeter in storage unit 20, in association with each other. Control unit 50 also stores positional data of a non image-forming area appearing in FIG. 5 and a value of laser light irradiation intensity of laser light sources necessary to provide irradiation energy of 4.00 joules per square centimeter in storage unit 20, in association with each other.

Control unit 50 causes sensor 66*c* to monitor transportation of a sheet, and if an edge of a sheet is detected by sensor 66*c* (step S53; YES), control unit 50 causes laser fixing device 66 to irradiate laser light (step S54). When doing so, control unit 50 determines a part of the sheet passing through an irradiation area of laser light sources 66*a*, on the basis of a detection timing made by sensor 66*c* and a speed of the transportation of the sheet by sheet transport device 66*b*, and causes laser light sources 66*a* to irradiate laser light at a laser light irradiation intensity associated with positional data of the determined part in storage unit 20. In the process, control unit 50 causes laser light sources 66*a* to irradiate laser light so that energy of light irradiated to an area in which toner has been transferred is lower than that of light irradiated to an area in which no toner has been transferred. As a result, in an image-forming area of the sheet laser light having irradiation energy of 0.71 joules per square centimeter is irradiated, and in a non image-forming area of the sheet, laser light having irradiation energy of 4.00 joules per square centimeter is irradiated. Accordingly, not only toner densely applied to an area corresponding to an electrostatic latent image formed by exposure, but also toner undesirably applied to an area other than that of the electrostatic image can be effectively fixed on the sheet.

As described above, image-forming areas al and a include an area in which no image exists, in a strict sense. In this area, since an applied irradiation energy is not sufficient, a certain amount of undesirably applied toner cannot be fixed on the sheet. Even so, as compared with a case in which laser light is irradiated to an entire area of a sheet, having an irradiation energy of 0.71 joules per square centimeter, a relatively large amount of undesirably applied toner can, nonetheless, be fixed to the sheet. Namely, an effect is obtained whereby an amount of undesirably applied toner that is unable to be fixed to a sheet is reduced.

(3) Modifications (3-1) Modification 1

In the above exemplary embodiment, where irradiation energy of laser light is determined depending on whether an area to be irradiated is an image-forming are or a non image-forming area; in the image-forming area, irradiation energy of laser light may be determined depending on a level of a pixel value included in the image-forming area. Alternatively, irradiation energy of laser light may be determined depending on a type of a color material used as a toner.

(3-2) Modification 2

In the above exemplary embodiment, where laser fixing device 66 includes plural laser light sources 66*a* arranged in a grid pattern, laser fixing device 66 may include a laser light source that is able to scan a sheet one-dimensionally or two-dimensionally.

(3-3) Modification 3

In the above exemplary embodiment, where an image-forming area includes an area in which no image exists, in a strict sense, an image-forming area may be defined as an area in which an image exists, not including an area in which no image exists, if a position of a sheet to be irradiated can be precisely controlled.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing unit that irradiates light to an image area color material transferred to a medium at a position specified by image data and that irradiates light to a non-image area color material transferred to a medium at a position outside an area specified by the image data in order to fix the image area color material and the non-image area color material on the medium; and a control unit that controls irradiation of light of the fixing unit so that an energy of light irradiated to an image-forming area on the medium including an area in which the image area color material has been transferred at the position specified by the image data is lower than an energy of light irradiated to a non image-forming area on the medium other than the image-forming area.

2. The fixing device according to claim 1, the fixing unit including a plurality of laser light sources arranged in a matrix.

3. An image-forming device comprising:

a unit that forms an electrostatic latent image at a position specified by image data, develops the electrostatic latent image using a color material, and transfers the developed image to a medium;

a fixing unit that irradiates light to the color material transferred to the medium at a position specified by the image data, to fix the color material on the medium; and a control unit that controls irradiation of light of the fixing unit so that an energy of light irradiated to an image-forming area on the medium including an area in which the color material has been transferred at the position specified by the image data is lower than an energy of light irradiated to a non image-forming area on the medium other than the image-forming area.

4. A fixing method comprising:

irradiating light to an image area color material transferred to a medium at a position specified by image data and to a non-image area color material transferred to a medium at a position outside an area specified by the image data in order to fix the image area color material and the non-image area color material on the medium; and controlling irradiation of light so that an energy of light irradiated to an image-forming area on the medium including an area in which the image area color material has been transferred at the position specified by the image data is lower than an energy of light irradiated to a non image-forming area on the medium other than the image-forming area.

5. The fixing method according to claim 4, the irradiating of light being performed by a plurality of laser light sources arranged in a matrix.

* * * * *